US007011224B2

(12) United States Patent
Sheng-Bin

(10) Patent No.: US 7,011,224 B2
(45) Date of Patent: Mar. 14, 2006

(54) SOFT STORAGE BIN

(75) Inventor: Hsieh Sheng-Bin, GuangDong (CN)

(73) Assignee: Sourcing Solutions, Inc., Hudson, WI (US)

( * ) Notice: Subject to any disclaimer, the term of this patent is extended or adjusted under 35 U.S.C. 154(b) by 0 days.

(21) Appl. No.: 10/633,858

(22) Filed: Aug. 4, 2003

(65) Prior Publication Data

US 2005/0029260 A1 Feb. 10, 2005

(51) Int. Cl.
*B65D 6/22* (2006.01)

(52) U.S. Cl. ..... 220/6

(58) Field of Classification Search ..... 220/901, 220/9.2, 9.3, 9.4, 6, 4.28, 4.29; 190/107; 383/4, 97, 119
See application file for complete search history.

(56) References Cited

U.S. PATENT DOCUMENTS 2,485,028 A * 10/1949 Bauernfreund et al. ..... 220/6
2,778,560 A * 1/1957 Pfeiffer ..... 220/9.2
4,630,746 A 12/1986 Fortenberry
4,756,416 A * 7/1988 Johnson ..... 206/335
4,903,859 A * 2/1990 Derby et al. ..... 383/119
5,285,656 A 2/1994 Peters
5,492,269 A 2/1996 Sung
5,996,882 A 12/1999 Randall
6,102,569 A 8/2000 Wang
6,116,045 A 9/2000 Hodosh et al.
6,149,025 A * 11/2000 Wang ..... 220/6
6,203,198 B1 * 3/2001 Stone ..... 383/119
6,238,091 B1 5/2001 Mogil
6,244,443 B1 * 6/2001 Nickell et al. ..... 206/600
6,276,582 B1 8/2001 Alexander
6,409,076 B1 6/2002 Wang
6,588,590 B1 7/2003 Wang

* cited by examiner

*Primary Examiner*—Stephen Castellano
(74) *Attorney, Agent, or Firm*—Jansson, Shupe, Munger & Antaramian, Ltd.

(57) ABSTRACT

A soft storage bin made from flexible material and having a bottom, two first sidewalls, two second sidewalls, and a top opening. A hard full-wall board is embedded in each of the two first sidewalls and at least one set of two hard half-wall boards is embedded in at least one of the second sidewalls. The two half-wall boards are separated from each other by a folding line. A hard bottom board is seated within the interior of the body of the drawer and is supported by the bottom. Each drawer can be collapsed by moving the bottom board away from the bottom to allow the second sidewalls to be folded inward. Preferably, two half-wall boards are embedded in each second sidewall. A full-wall pocket is provided each first sidewall to receive the full-wall board and each second sidewall is provided two half-wall pockets to receive each half-wall board.

20 Claims, 2 Drawing Sheets

SOFT STORAGE BIN

FIELD OF THE INVENTION

This invention is related generally to storage containers and, more particularly, to erectable/collapsible storage containers having a body of flexible material.

BACKGROUND OF THE INVENTION

Certain soft storage bins are known in the prior art. Soft storage bins are containers having a body made from a flexible material such as canvas or leather. Many of them, however, are not collapsible. Those bins that can be collapsed have complicated structures making it difficult to do so. They require a certain degree of manual dexterity on the part of individuals attempting to fold or flatten them. Others are costly to manufacture or are collapsible only after the supporting framework of the bin has been disassembled into multiple parts.

Soft storage bins of simple structure that could be collapsed and later erected into its original shape without extensive assembly would provide numerous benefits to consumers. Their light weight would enable them to be easily carried with their contents to whatever location is desired. When empty, these bins could be collapsed so as not to take up unnecessary space.

Collapsible soft storage bins in the prior art typically do not feature stiff or rigid sidewalls. Stiff sidewalls would be highly desirable since they would enable the bins to be more durable and thereby have a longer useful life. Stiff sidewalls would also enable the bin to be self-supporting when erected and would ensure that the bin maintains the same structure no matter the number of times it has been collapsed and later re-erected.

OBJECTS OF THE INVENTION

It is a primary object of this invention to provide a erectable/collapsible soft storage bin that overcomes some of the problems and shortcomings of the prior art, including those mentioned above.

Another object of this invention is to provide a soft storage bin that can be collapsed and later erected into its original shape.

Another object of this invention is to provide a novel soft storage bin that has an integral body of flexible material and is collapsible along vertical fold lines in its sidewalls.

Another object of the invention is to provide an exceptional soft storage bin that is simple in structure, easy to collapse, and inexpensive to manufacture.

Another object of the invention is to provide an improved erectable/collapsible soft storage bin that has light weight, self-supporting when erected, and durable.

SUMMARY OF THE INVENTION

The invention is directed to a novel soft storage bin. Each bin in accordance with this invention includes a body of flexible material having a bottom, two first sidewalls, two second sidewalls, and a top opening. A hard full-wall board is embedded in each of the two first sidewalls and at least one set of two hard half-wall boards is embedded in one of the two second sidewalls. The two half-wall boards of each set are separated from one another by a folding line. The bin also has a hard bottom board seated inside the bin so that the board is supported by the fabric bottom. Moving the bottom board away from the bottom enables each bin to be collapsed through the inward folding of the two second sidewalls.

In preferred embodiments of this invention, each first sidewall has a length greater than the length of either second sidewall. It is more preferred in certain embodiments that the bin have a set of two hard half-wall boards embedded in each of the second sidewalls. Most desirable is where the folding line in the second sidewalls is orthogonal or perpendicular to the bottom edge of each second sidewall. In particular, it is highly preferred that this folding line not only be perpendicular to but bisect the second sidewall's bottom edge.

Most desirable is when these embodiments have the first sidewalls and the second sidewalls opposite and substantially identical or congruent to each other, respectively. More desirable are embodiments where each sidewall is orthogonal, i.e. perpendicular, to the bottom of the soft storage bin. In these embodiments, it is highly preferred that all four sidewalls form a rectangular top edge that rests in a substantially horizontal plane, i.e. in a plane substantially parallel to the bottom.

In certain desirable embodiments, each first sidewall includes a full-wall pocket to receive the full-wall board embedded within that sidewall and each second sidewall forms a pair of half-wall pockets in which to insert the two half-wall boards. Also preferred are embodiments where the bin also includes a handle on at least one of the sidewalls. In other most preferred forms of the invention, the bottom board is removable from the interior of the body of the bin.

Highly desired embodiments find each sidewall attached to each adjacent sidewall along their common vertical edge and to the bottom along the sidewall's bottom edge so that the bin comprises an integral body of flexible material. The term "integral" as used herein refers to the state of completeness in the construction of the body of the bin from flexible material, i.e. a continuous piece of material with or without seams, such that no further assembly or addition is needed to form the body of the bin.

In another aspect of this invention, the bin comprises (1) a body of flexible material having a bottom, two first sidewalls, two second sidewalls, and a top opening; (2) at least one hard fill-wall end board embedded in at least one of the first sidewalls; (3) one set of two hard half-wall boards embedded in each of the two second sidewalls, each pair of half-wall side boards being separated by a folding line; and (4) a hard bottom board seated within the interior of the bin and supported by its bottom. The bin is capable of being collapsed substantially flat with movement of the bottom board whereby the second sidewalls can be folded inward.

A preferred embodiment of this aspect of the invention is where the folding line in each second sidewall is perpendicular to the bottom edge of the sidewall at its midpoint. It is most preferred that the sidewalls and bottom be attached to each other so as to form an integral body. More preferred embodiments are where the first sidewalls are opposed and substantially identical to each other, the second sidewalls are also opposed and substantially identical to each other, each sidewall is orthogonal to the bottom, and the sidewalls form a rectangular top edge to the body of the bin that is substantially horizontal.

Highly desirable embodiments find both first sidewalls embedded with a hard full-wall board. In certain preferred cases, the length of each first sidewall is greater than the length of either second sidewall.

Another desired aspect of this invention is directed towards a soft storage bin comprising a body of flexible material having a bottom, two opposed and substantially identical first sidewalls, two opposed and substantially identical second sidewalls, and a top opening defining an interior. The bin also includes two hard full-wall boards respectively embedded in the two first sidewalls and two sets of hard half-wall boards respectively embedded in the two second sidewalls. Each pair of half-wall boards is separated from one another by a vertical folding line in each second sidewall. In addition, this novel bin has a hard bottom board seated within the interior and supported by the bottom to facilitate the collapse of the bin when the bottom board is removed.

In certain highly preferred embodiments of this form of the invention, each sidewall is orthogonal to the bottom and the body of the bin has a substantially horizontal and rectangular top edge. Most preferred is where the first sidewalls are longer than the second sidewalls.

DETAILED DESCRIPTION OF PREFERRED EMBODIMENTS

The drawings illustrate an exceptional bin 20 that can be easily erected and collapsed in accordance with this invention. Bin 20 is comprised of a body 22 formed from flexible material. Such flexible materials range from woven fabrics such as canvas to such non-woven substances as leather, polypropylene, and polyvinyl chloride. Body 22 need not be formed from a single material but can, for example, have an outer wall of canvas and an inner wall of polypropylene for ease in cleaning. Other useful combinations will be apparent to those skilled in the art.

Figure 1:
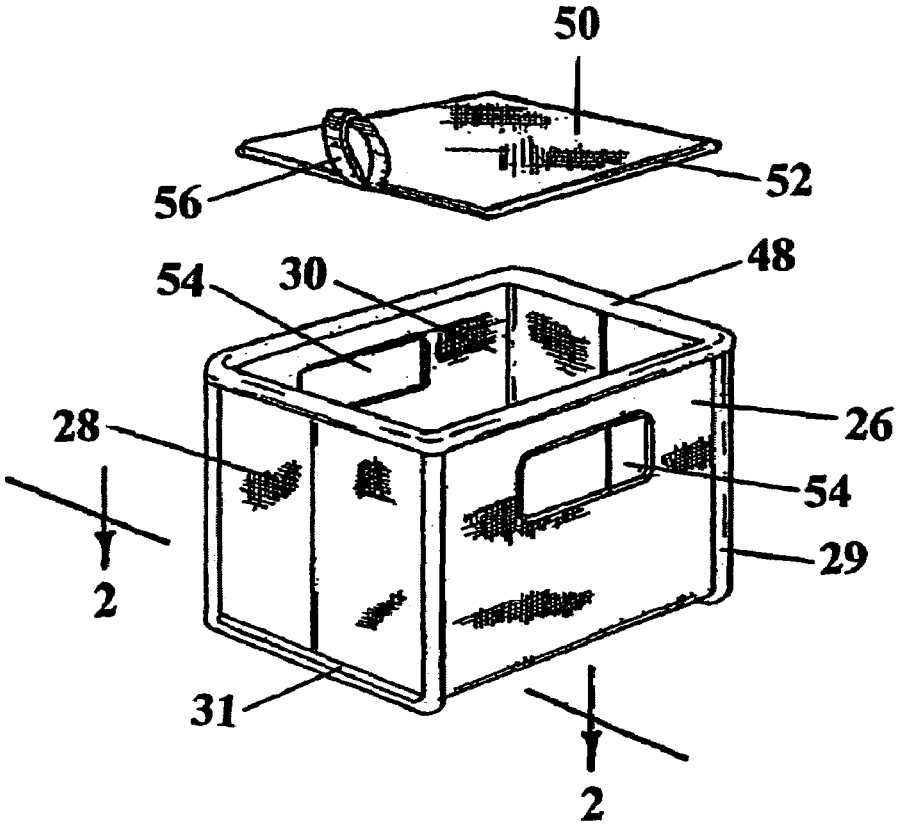
FIG. 1 is an exploded view of a soft storage bin in accordance with this invention.
Figure 2:
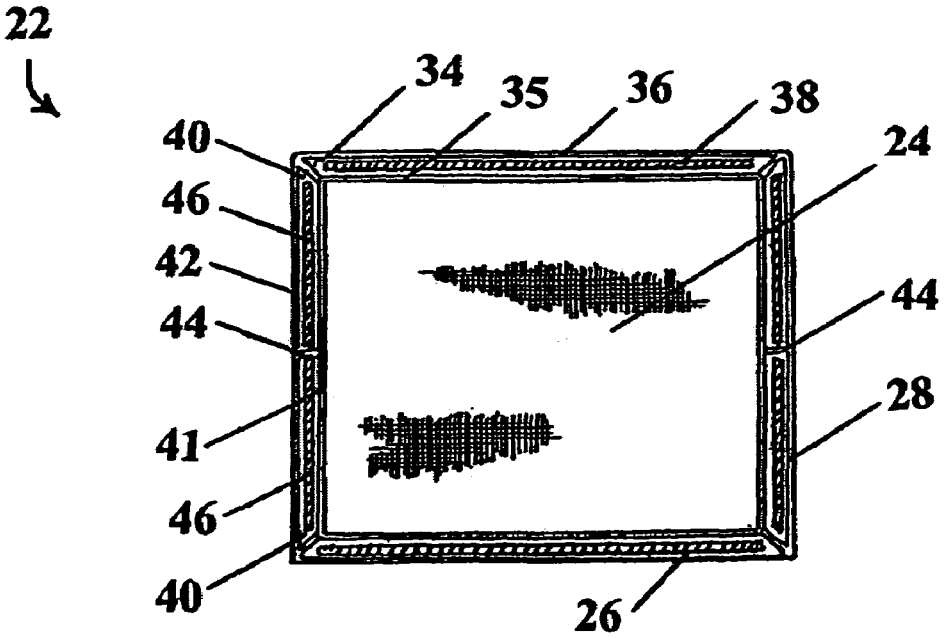
FIG. 2 is a top sectional view of the bin along section line 2—2 in FIG. 1.

As illustrated in FIGS. 1–2, body 22 has a bottom 24, two first sidewalls 26, and two second sidewalls 28. Each sidewall 26, 28 is permanently joined to the two adjacent sidewalls along both of its vertical edges 29 to form a contiguous peripheral ring. Each sidewall 26, 28 is also permanently attached to bottom 24 along bottom edge 31.

The union between sidewalls 26, 28 along vertical edges 29 and between sidewalls 26, 28 and bottom 24 along bottom edges 31 establishes a body 22 that is integral. Attachment of sidewall 26 with sidewall 28 or of sidewall 26, 28 with bottom 24 is achieved either by using the same material for both portions or by joining two separate pieces of material together as with stitches or adhesive in a manner known to those skilled in the art. This joins adjacent portions without restricting movement along edges 29, 31.

First sidewalls 26 are situated opposite from each other within body 22. First sidewalls 26 are substantially vertical, i.e. perpendicular or orthogonal to bottom 24, and substantially equivalent in size and shape. Each first sidewall 26 has a full-wall pocket 34. Full-wall pocket 34 is formed from first inner-wall 35 and first outer-wall 36 being joined along vertical edges 29 and bottom edge 31. Full-wall pocket 34 is sized to receive a hard full-wall board 38. Each full-wall board 38 is preferably thin with a height and width slightly less than the corresponding dimensions of the receiving full-wall pocket 34.

Second sidewalls 28 are likewise opposite each other, substantially vertical, and substantially congruent. Each second sidewall 28 has two half-wall pockets 40. Both half-wall pockets 40 are formed from second inner-wall 41 and second outer-wall 42 being attached along vertical edges 29 and bottom edge 31. Each half-wall pocket 40 is separated from the other by a folding line 44 formed by joining second inner-wall 41 to second outer-wall 42 along line 44 between top edge 48 and bottom edge 31. Folding line 44 is vertical, i.e. orthogonal to bottom edge 31, and mid-point between adjacent vertical edges 29. Each half wall pocket 40 is sized to receive a half wall board 46. Similar to full-wall board 38, each half-wall board 46 is preferably thin with a height and width slightly less than the respective dimensions for the corresponding half-wall pocket 40.

After a full-wall board 38 has been embedded within the full-wall pocket 34 of each first sidewall 26, full-wall board 38 is secured within full-wall pocket 34 by joining first inner-wall 35 to first outer-wall 36 along top edge 48. In a similar manner, each half-wall board 46 is secured within its corresponding half-wall pocket 40 by joining second inner-wall 41 to second outer-wall 42 along top edge 48 of the respective second sidewall 28.

Figure 3:
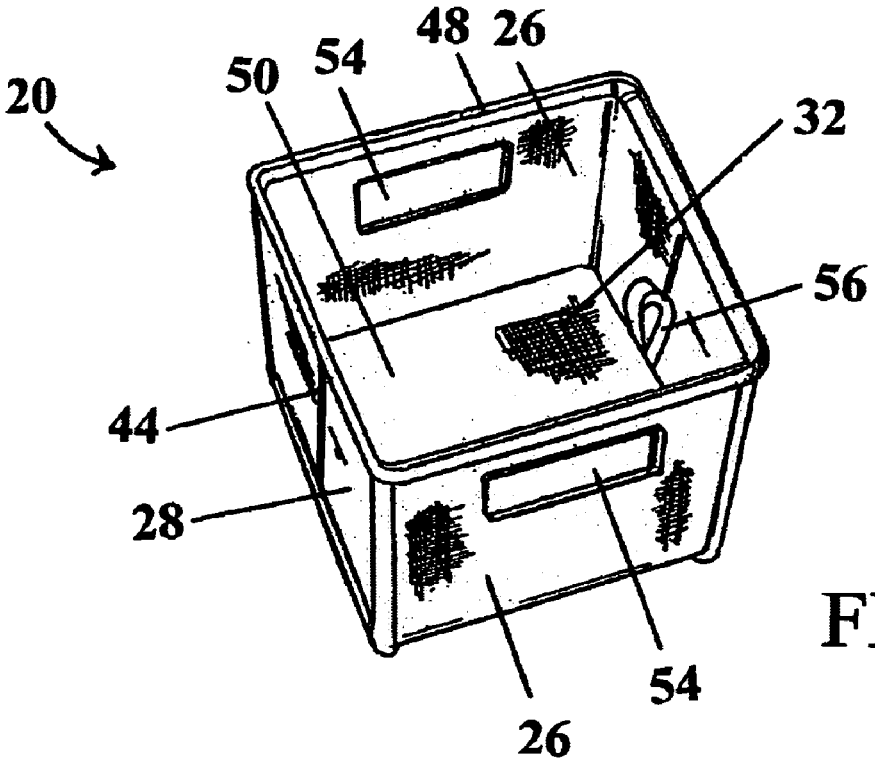
FIG. 3 is a perspective view of a bin in accordance with this invention.

Body 22 has a top opening 30 formed by top edges 48 that provides access to the interior 32 of the bin 20. As seen in FIG. 3, a hard bottom board 50 is placed within interior 32 to rest upon bottom 24. Bottom board 50 is preferably covered in the same material as comprising body 22. Bottom board 50 is sized so as to allow its side edges 52 to frictionally contact inner walls 35, 41 of each sidewall 26, 28.

Figure 4:
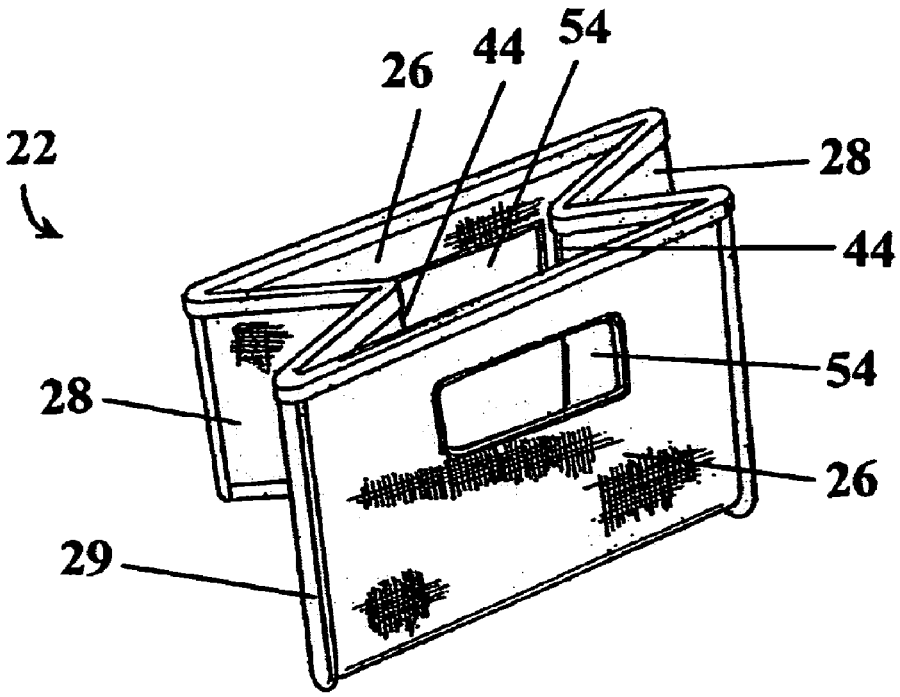
FIG. 4 is a perspective view of the bin in FIG. 3 being collapsed after the bottom board has been removed.

When bin 20 is erected, bottom board 50 maintains each sidewall 26, 28 in an upright orientation. Pivoting bottom board or removing it entirely from interior 32 so that bottom board 50 no longer rests upon bottom 24 allows second sidewalls 28 to fold inward along folding line 44 as illustrated in FIG. 4. Bin 20 can be collapsed into a substantially flat configuration by permitting each second sidewall 28 to fold in half in this manner. Loop 56 is attached to bottom board 50 as an aid when inserting and removing bottom board 50 into and from body 22.

Each full-wall board 38 and each pair of half-wall boards 46 provide reinforcement to sidewalls 26, 28. This reinforcement allows the flexible material of sidewalls 26, 28 to stand upright when bin 20 is erected. Boards 38, 46 also give sidewalls 26, 28 the rigidity needed to increase the durability and the useful life of bin 20. Moreover, such rigidity insures that bin 20 returns substantially to its original shape despite being repeatedly collapsed and then re-erected. Boards 38, 46 are preferably made from cardboard but even particle board or sheet metal can be used.

As shown in FIGS. 1, 3 and 4, bin 20 is provided with a handle-aperture 54 on each first sidewall 26 to serve as a handle. A handle for use on bin 20 can be provided in a number of other ways apparent to those skilled in the art, such as the attachment of a strap to each first sidewall 26.

While the principles of the invention have been shown and described in connection with specific embodiments, it is to be understood that such embodiments are by way of example and are not limiting.

What is claimed is:

1. A soft storage bin comprising:

a body of flexible material, the body forming a closed bottom, two first sidewalls and two second sidewalls, the bottom being bound to each sidewall along a bottom edge, and the body defining an interior having a top opening;

each first sidewall forming a full-wall pocket to receive a hard full-wall board embedded therein;

at least one second sidewall having a substantially vertical folding-seam forming two half-wall pockets, each half-wall pocket receiving one hard half-wall board embedded therein, and abutting one full-wall pocket along a vertical edge; and a hard bottom board seated within the interior and supported by the bottom, whereby removing the bottom board from the interior enables the bin to be collapsed by folding into the interior each second sidewall along the folding-seam and folding over the bottom.

2. The bin of claim 1 wherein each sidewall has a length and the length of each first sidewall is greater than the length of either second sidewall.

3. The bin of claim 2 wherein each second sidewall has a substantially vertical folding-seam forming two half-wall pockets, each half-wall pocket receiving one hard half-wall board embedded therein, and abutting one full-wall pocket along a vertical edge.

4. The bin of claim 3 wherein the folding-seam is orthogonal to the bottom edge at the midpoint thereof.

5. The bin of claim 4 wherein the body has two opposed and substantially identical first sidewalls and two opposed and substantially identical second sidewalls.

6. The bin of claim 5 wherein each sidewall is orthogonal to the bottom.

7. The bin of claim 6 wherein the body has a rectangular top edge in a substantially horizontal plane.

8. The bin of claim 1 wherein each sidewall is bound to each adjacent sidewall along the vertical edge therebetween whereby the bin has an integral body of flexible material.

9. The bin of claim 1 wherein each bin further comprises a handle on at least one sidewall.

10. The bin of claim 1 wherein the bottom board is removable from the interior of the body.

11. A soft storage bin comprising:

a body of flaccid material, the body forming a closed bottom, two first sidewalls and two second sidewall, to bottom being bound to each sidewall along a bottom edge, and the body defining an interior having a top opening;

one hard full-wall board embedded in at least one of the first sidewalls;

two hard half-wall boards embedded in each of the second sidewall, the two half-wall boards being separated from one another by a folding-seam in the body; and a hard bottom board removably seated within the interior and having a surface entirely abutting the bottom such that the bottom board is uniformly supported by the bottom, whereby moving the bottom board away from the bottom enables the bin to be collapsed.

12. The bin of claim 11 wherein the folding-seam is orthogonal to the bottom edge at the midpoint thereof.

13. The bin of claim 12 wherein each sidewall is bound to each adjacent sidewall along a vertical edge therebetween whereby the bin has an integral body of flaccid material.

14. The bin of claim 13 wherein:

the body has two opposed and substantially identical first sidewalls and two opposed and substantially identical second sidewalls;

each sidewall is orthogonal to the bottom; and the body has a rectangular top edge in a substantially horizontal plane.

15. The bin of claim 14 wherein a hard full-wall board is embedded in each of the first sidewalls.

16. The bin of claim 15 wherein each sidewall has a length and the length of each first sidewall is greater than the length of either second sidewall.

17. A soft storage bin comprising:

a contiguous body of flexible material, said body forming a closed bottom, two opposed and substantially identical first sidewalls and two opposed and substantially identical second sidewalls, the body defining an interior having a top opening;

a hard full-wall board embedded in each of the two first sidewalls;

two sets of two hard half-wall boards respectively embedded in the two second sidewalls, the two half-wall boards of each set being separated from one another by a vertical folding-seam in the body; and a hard bottom board seated within the interior and supported by the bottom, whereby removal of the bottom board from the bottom enables the bin to be collapsed by folding into the interior each second sidewall along the folding-seam and folding over the bottom.

18. The bin of claim 17 wherein each sidewall is orthogonal to the bottom and the body has a rectangular top edge in a substantially horizontal plane.

19. The bin of claim 18 wherein each sidewall has a length and the length of each first sidewall is greater than the length of either second sidewall.

20. The bin of claim 17 wherein each first sidewall forms a full-wall pocket to receive one full-wall board and each second sidewall forms two half-wall pockets, each half-wall pocket to receive one half-wall board.

* * * * *

UNITED STATES PATENT AND TRADEMARK OFFICE

CERTIFICATE OF CORRECTION

PATENT NO. : 7,011,224 B2
APPLICATION NO. : 10/633858
DATED : March 14, 2006
INVENTOR(S) : Hsieh Sheng-Bin It is certified that error appears in the above-identified patent and that said Letters Patent is hereby corrected as shown below:

Column 1, line 39, delete the word "a" second occurence and replace with the word --an--.
Column 1, line 53, delete the word "has" and replace with the word --is--.

Column 2, line 42, delete the word "fill" and replace with the word --full--.

Column 5, line 39, delete the words "sidewall, to" and replace with the words --sidewalls, the--.
Column 5, line 46, delete the word "sidewall" and replace with the word --sidewalls--.

Signed and Sealed this

Tenth Day of October, 2006

JON W. DUDAS
*Director of the United States Patent and Trademark Office*